US010246203B2

(12) United States Patent
Rasi

(10) Patent No.: US 10,246,203 B2
(45) Date of Patent: Apr. 2, 2019

(54) PACKAGING APPARATUS AND METHOD FOR NAPPIES OR OTHER SOFT, FLAT, FOLDED SANITARY ARTICLES

(71) Applicant: TISSUE MACHINERY COMPANY S.p.A., Bologna (IT)

(72) Inventor: Michele Rasi, Ferrara (IT)

(73) Assignee: TISSUE MACHINERY COMPANY S.p.A., Bologna (IT)

( * ) Notice: Subject to any disclaimer, the term of this patent is extended or adjusted under 35 U.S.C. 154(b) by 609 days.

(21) Appl. No.: 14/441,533

(22) PCT Filed: Nov. 8, 2013

(86) PCT No.: PCT/IB2013/060013

§ 371 (c)(1),
(2) Date: May 8, 2015

(87) PCT Pub. No.: WO2014/072951

PCT Pub. Date: May 15, 2014

(65) Prior Publication Data

US 2015/0307218 A1 Oct. 29, 2015

(30) Foreign Application Priority Data

Nov. 9, 2012 (IT) ..... BO2012A0619

(51) Int. Cl.
*B65B 25/14* (2006.01)
*B65B 63/02* (2006.01)
(Continued)

(52) U.S. Cl.
CPC ..... *B65B 25/145* (2013.01); *B65B 11/004* (2013.01); *B65B 11/22* (2013.01);
(Continued)

(58) Field of Classification Search
CPC ..... B65H 2701/1924; B65H 2404/311; B65H 2404/3111; B65H 2301/34112;
(Continued)

(56) References Cited

U.S. PATENT DOCUMENTS 2,741,885 A * 4/1956 Allison ..... B29C 65/7433 100/17
2,962,848 A * 12/1960 Wilson ..... B65B 11/22 206/83.5

(Continued)

FOREIGN PATENT DOCUMENTS

EP 0439818 A1 8/1991
EP 0 679 579 A1 11/1995

(Continued)

OTHER PUBLICATIONS

International Search Report and Written Opinion for corresponding patent application No. PCT/IB32013/060013 dated Feb. 17, 2014.

(Continued)

*Primary Examiner* — Stephen F. Gerrity
*Assistant Examiner* — Joshua G Kotis
(74) *Attorney, Agent, or Firm* — Renner, Otto, Boisselle & Sklar LLP

(57) ABSTRACT

A packaging apparatus (1) for nappies (2) or other soft, flat, folded sanitary articles comprises: packaging arrangement for positioning a plastic film so it is tight against a set (4) of nappies (2); a feeder (6) set up to feed the nappies to the packaging arrangement; at least one comb (10) configured to selectively withdraw groups (8) of nappies from a nappy (2) stacker device (9) and place them on the feeder (6). The packaging arrangement comprises a wrapping machine (3) configured to fold a sheet (5) of the film round the set (4) of nappies (2) and to close it on at least three sides of the set (4) of nappies (2).

17 Claims, 5 Drawing Sheets

(51) Int. Cl.

| | |
|---|---|
| ***B65B 11/00*** | (2006.01) |
| ***B65B 49/00*** | (2006.01) |
| ***B65B 35/44*** | (2006.01) |
| ***B65B 51/14*** | (2006.01) |
| ***B65B 11/22*** | (2006.01) |

(52) U.S. Cl.
CPC ..... *B65B 35/44* (2013.01); *B65B 49/00* (2013.01); *B65B 51/14* (2013.01); *B65B 63/02* (2013.01); *B65B 63/026* (2013.01)

(58) Field of Classification Search
CPC ..... B65H 2301/342; B65H 2301/3422; B65H 2301/3423; B65B 25/145; B65B 63/02; B65B 63/022; B65B 63/026; B65B 11/004; B65B 11/16; B65B 11/18; B65B 11/20; B65B 11/22; B65B 11/26; B65B 35/405; B65B 35/44; B65B 35/46; B65B 35/50; B65B 51/14
USPC ..... 53/429, 439, 529, 530, 228–234, 526, 53/528; 414/789.5, 790, 790.1, 790.9, 414/791
See application file for complete search history.

(56) References Cited

U.S. PATENT DOCUMENTS 3,006,119 A 10/1961 Fingerhut
3,267,642 A * 8/1966 Broadbent ..... B65B 11/20 53/228
3,619,976 A * 11/1971 Kerker ..... B65B 27/08 414/791
3,648,431 A * 3/1972 Hartbauer ..... B65B 27/08 493/386
3,729,886 A * 5/1973 Lucas ..... B65B 63/026 53/209
3,848,398 A * 11/1974 Suhr ..... B65B 9/026 53/530
4,062,169 A * 12/1977 Lister ..... B65B 5/067 53/258
4,141,193 A * 2/1979 Joa ..... B65B 25/20 198/408
4,577,453 A * 3/1986 Hofeler ..... B65B 35/50 414/907
4,679,379 A * 7/1987 Cassoli ..... B65B 9/073 100/232
4,738,078 A * 4/1988 Benz ..... B65B 11/10 53/228
5,022,216 A * 6/1991 Muckenfuhs ..... B65B 63/02 53/438
5,127,209 A * 7/1992 Hunter ..... B65B 35/44 198/419.3
5,897,291 A * 4/1999 Gerwe ..... B65B 35/24 198/374
5,897,292 A * 4/1999 Gerwe ..... B65G 47/082 198/374
6,018,933 A * 2/2000 Gallagher ..... B65B 63/02 53/438
6,223,500 B1 * 5/2001 Kramps ..... B65B 11/10 53/229
6,318,053 B1 * 11/2001 Frank ..... B65B 9/026 53/528
6,755,008 B2 6/2004 Schmetzer et al.
8,713,901 B2 * 5/2014 Dorronsoro Martin ..... B65B 25/145 53/447
2002/0124533 A1 9/2002 Schmetzer et al.
2004/0011005 A1 * 1/2004 Daoust ..... B65B 11/10 53/436
2007/0264115 A1 11/2007 Orth
2007/0271872 A1 * 11/2007 De Matteis ..... B65B 11/10 53/228
2012/0167527 A1 * 7/2012 Michler ..... B65B 63/02 53/429
2013/0068590 A1 * 3/2013 Fujita ..... B65G 47/841 198/426
2014/0137515 A1 * 5/2014 Brandhorst ..... B65B 35/44 53/439

FOREIGN PATENT DOCUMENTS

EP 0679579 A1 * 11/1995 ..... B65B 9/026
WO 99/18021 A1 4/1999
WO 2005/040020 A1 5/2005
WO 2011/143319 A2 11/2011

OTHER PUBLICATIONS

European Office Action for corresponding Patent Application No. 13 801 819.7-1016 dated Apr. 26, 2018.

* cited by examiner

PACKAGING APPARATUS AND METHOD FOR NAPPIES OR OTHER SOFT, FLAT, FOLDED SANITARY ARTICLES

RELATED APPLICATION DATA

This application is a national phase of International Application No. PCT/IB2013/060013 filed Nov. 8, 2013 and published in the English language.

TECHNICAL FIELD

This invention relates to a packaging apparatus and method for nappies or other sanitary articles which are soft, flat (that is flattened in shape) and folded. More specifically, besides nappies, "soft, folded sanitary articles" means sanitary towels and wet wipes.

BACKGROUND ART

Generally speaking, the invention relates to the packaging of flat objects formed from at least two sides folded on top of each other.

The products thus have a head end, defined by the edge formed by the folded sides, and a tail end, defined by the free edges of the sides.

For convenience of description, this specification will hereinafter refer to nappies but without thereby intending to limit the scope of the invention, in light of the above.

The packaging of articles of this kind presents several problems, due to the fact that such objects are soft, which means their volume is subject to considerable variations, and asymmetrical (that is, they are flat, with a head end and a tail end, unlike other products, such as rolls of toilet paper which are cylindrically symmetric).

In light of this, prior art apparatuses for packaging nappies (as described, for example, in documents US2007264115, WO2005040020 and U.S. Pat. No. 6,755,008), comprise a bagging machine fed by a conveyor positioned in line with the bagging machine, in order to withdraw groups of nappies from a stacker device and move them in straight line into a preformed plastic bag (held open).

These apparatuses have some disadvantages, however.

One disadvantage is due to the need to feed the device continuously with preformed plastic bags (which also leads to problems caused by static electricity).

Another disadvantage is due to the need to correct the orientation of the nappies as they are conveyed from the stacker device to the bagging machine, by turning them by 180 sexagesimal degrees, to ensure that the nappies are inserted into the bag with the head end facing forwards in the direction of insertion. That is because when the nappies are withdrawn from the stacker device, their head ends face the direction opposite to that in which they are inserted into the bag.

Prior art packaging apparatuses are therefore complex and expensive.

Another disadvantage of prior art nappy packaging systems arises from the need to provide a secondary packaging (that is, a product package consisting of sets of nappies which have already been packaged).

One of the problems with the secondary packaging is to avoiding sealing of LDPE on LDPE which, even if especially surface-treated, does not guarantee that the film of the bag (primary packaging) and the bundle (secondary packaging) will adhere to each other.

DISCLOSURE OF THE INVENTION

The aim of this invention is to provide a particularly simple and inexpensive packaging apparatus and method for nappies (or similar soft, folded sanitary articles).

Another aim of the invention is to provide a nappy packaging apparatus and method which is particularly efficient in terms of packaging output per hour.

A further aim of the invention is to provide a nappy packaging apparatus and method which facilitates packaging sets of nappies arranged in two or more superposed rows.

Yet another aim of the invention is to provide a nappy packaging apparatus and method which facilitates making a "secondary" package of a plurality of packages of corresponding sets of nappies.

These aims are fully achieved by the apparatus and method according to the invention as characterized in the appended claims.

More specifically, the apparatus according to the invention comprises:

- packaging arrangement for positioning a plastic film so it is tight against a set of nappies;
- a feeder set up to feed the nappies to the packaging arrangement;
- a comb configured to selectively withdraw groups of nappies from a nappy stacker device.

According to the disclosure, the packaging arrangement comprises a wrapping machine configured to fold round the set of nappies a sheet of the film obtained from a roll and to close it on at least three sides of the set of nappies (more specifically, one underside face and two lateral faces).

In effect, this avoids the need for a bagging machine (thus avoiding having to feed preformed bags).

Preferably (but not necessarily), closing involves applying three seals, one on each face of the set of nappies.

It should be noted that the sheet of film is a thin sheet (obtained from a web) which has not been folded or sealed beforehand (for example to form a bag) but is folded and sealed round the set of nappies.

Preferably, the feeder comprises a conveyor for receiving the groups of nappies from the stacker device and moving them onto a conveying plane.

More specifically, the conveyor is configured to move the nappies, withdrawn from the stacker device, along a longitudinal direction.

Preferably, the conveying plane (and hence the longitudinal direction) is horizontal (that is, parallel to a supporting surface of the apparatus, that is, perpendicular to the weight force) or substantially horizontal.

The feeder also comprises an elevator configured to withdraw the groups of nappies from the conveyor and to move them along an inclined direction at an angle to the conveying plane to feed them to the wrapping machine (preferably up to and inside the wrapping machine).

Preferably, the elevator is configured to move the groups of nappies along a direction substantially perpendicular to the conveying plane (that is, to the longitudinal direction). Preferably, the elevator is configured to move the groups of nappies along a substantially vertical direction (that is, the direction of the weight force).

This allows making an apparatus of particularly reduced size.

It should also be noted that, preferably, the wrapping machine is configured to receive a set of nappies at an infeed station having a downwardly directed opening.

The opening of the infeed station of the wrapping machine has a lateral dimension (that is, measured transversely to the direction of receiving the sets of nappies) of predetermined value.

It should also be noted that the apparatus preferably comprises an accumulation station located between the conveyor and the infeed station of the wrapping machine.

The accumulation station is set up to retain two or more groups of superposed nappies to form a set of nappies comprising two or more layered groups of nappies.

In light of this, it should be noted that the elevator is preferably configured to withdraw two or more groups of nappies from the conveyor and to move them to the accumulation station to form a set of nappies having two or more layers.

Thus, the expression "group of nappies" means a plurality of nappies withdrawn from the accumulator device by the comb and placed on the conveyor. The nappies of the plurality are juxtaposed with each other in such a way that each nappy has at least one of its two flat faces facing a corresponding face of an adjacent nappy.

It should be noted that the groups of nappies are positioned on the conveyor in such a way that the flat lateral faces of the nappies are perpendicular to the conveying plane.

Preferably, the groups of nappies are positioned on the conveyor in such a way that the head ends and tail ends of the nappies are aligned on the conveying surface, in particular along the longitudinal conveying direction. Thus, the nappies of the group rest on the conveyor on edge so that the fold lines defined by the nappies are perpendicular to the conveying plane.

The expression "set of nappies" means a plurality of nappies fed into the wrapping machine.

Such a set of nappies may comprise one or even two or more groups of nappies superposed in such a way that the different groups of nappies are in contact with each other along the lateral edges (so that the flat faces of the nappies of the different groups are at different heights along the direction of movement in the elevator).

Preferably, the conveyor (of the feeder) comprises two side panels which are configured to contain and laterally guide the groups of nappies transported on the conveying plane and which are inclined at an angle to each other to define a guide tapered in the direction of nappy feed.

That way, the outwardly directed flat faces of the nappies at the ends of the group are in sliding contact with the side panel. Thus, the transversal dimension of the group of nappies (defined by the distance between the lateral end faces) is progressively reduced as the group of nappies advances along the conveyor within the side panels, because the distance between the side panels measured transversely to the longitudinal conveying direction (on the conveying plane) is progressively reduced from the infeed end to the outfeed end of the conveyor (because of the inclined or tapered configuration).

This causes the group of nappies to be laterally compressed enough to achieve a first compacting step (eliminating a part of the air from inside the group of nappies).

Preferably, the apparatus also comprises a presser, operatively coupled to the feeder and configured to laterally press the set of nappies (juxtaposed with each other in one or more rows) to compress it until reaching a lateral dimension having a predetermined reference value.

Preferably, the presser is located downstream of the side panels relative to a feed direction of the nappies in the feeder.

The presser is connected to an actuator (for example, of pneumatic, hydraulic, electric or other type) driven by a control unit.

The presser is configured to compress the group of nappies more than it was compressed during the first compacting step performed by the side panels.

Preferably, the presser (or rather, the control unit) is configured to press the set of nappies from the side until reaching a lateral dimension having a predetermined reference value smaller than a corresponding width defined by the infeed station of the wrapping machine, the infeed station being exactly set up in size to receive the set of nappies.

This makes it possible to prevent lateral expansion of the group of nappies (which has a form of elasticity because it acts like a sponge which can absorb and expel air from inside the nappies) while the nappies are being fed into the wrapping machine.

The wrapping machine comprises a sealing device.

Preferably, the sealing device has a first and a second folding element movable towards and away from each other, where each of the folding elements has a sealing surface.

The sealer is configured in such a way that the sealing surfaces of the two folding elements retain and press two flaps of the sheet of film interposed between them (after folding the sheet flaps projecting downwardly from the set of nappies and directed towards the infeed station of the wrapping machine) so as to close the sheet round the set of nappies at the bottom.

Advantageously, this makes the apparatus particularly fast and reduced in size.

The disclosure also provides a packaging method for nappies (or other soft, flat, folded sanitary articles).

The method comprises the following steps:

- withdrawing groups of nappies from a nappy stacker device through the agency of a comb and placing the groups of nappies on a feeder;
- feeding a set of nappies comprising one or more groups of nappies to packaging arrangement;
- positioning a plastic film so it is tight against the set of nappies in order to package the set of nappies itself.

According to the disclosure, the method comprises the following steps:

- preparing a sheet of the film obtained from a roll (and in any case seamless and without preliminary folds);
- folding the sheet round the set of nappies in order to wrap it;
- closing the sheet on at least three sides of the set of nappies.

Preferably, the feeding step comprises the following steps:

- transporting the groups of nappies along a conveying surface (more specifically, along a longitudinal direction, preferably horizontal) away from the stacker device;
- withdrawing the groups of nappies from the conveyor; and
- lifting the nappies (preferably vertically) along a direction which is inclined at an angle to the conveying surface.

The folding step is performed at the same time as at least the final part of the lifting step.

That is to say, the folding step occurs, at least partly, at the same time as the final part of the lifting step.

Preferably, during the steps of transporting, withdrawing and lifting, the nappies are positioned with their head ends directed rearwards relative to the feed direction while they are being transported away from the stacker device.

Advantageously, that simplifies the packaging process (in particular, the feeding part), since turning the groups of nappies by 180 degrees is an awkward operation that would slow the process).

Preferably, the method comprises a step of laterally compressing the set of nappies, which are juxtaposed with each other in one or more rows, until reaching a lateral dimension having a predetermined reference value which is smaller than the width of the set of nappies during the folding and sealing steps, where the compressing step is performed during at least a part of the feeding step.

The compressing step may be performed all at once by a compressor controlled by a control unit, or in the following two sub-steps: a preliminary compression (where a relatively reduced compressive force is applied) and a subsequent compression where a higher compressive force is applied.

Preferably, the step of closing the free flaps of the sheet of film comprises applying at least one seal (preferably, three seals).

Preferably, the step of applying at least one seal (for closing the sheet on an underside face of the set of nappies) comprises a step of moving the first and second folding elements towards each other in order to retain and press two flaps of the sheet interposed between respective sealing surfaces of the folding elements, to close the bottom of the sheet round the set of nappies.

Preferably, the method according to the disclosure comprises a further step of secondary packaging (in addition to the primary packaging described above).

In light of this, the method further comprises the following steps:

- preparing a further sheet of film obtained from a roll;
- folding the sheet round two or more previously packaged sets of nappies;
- closing the folded sheet on at least three sides of a volume defined by the plurality of packaged sets of nappies.

Advantageously, this provides a particularly large outside surface on which text and images relating to the product can be reproduced.

According to a further aspect of the disclosure, the apparatus comprises a stacker which requires a limited room and which is particularly efficient, because it does not require any manipulating unit upstream the input station of the stacker and renders inessential to have a manipulating unit downstream the output station of the stacker itself.

This stacker moves the groups of nappies along a closed loop which lays in a vertical plane; furthermore, it has at least two groups of paddles which are movable independently one from the other in the loop, in order to drive the groups of nappies from the input station to the output station; in this way, one group of paddles can be put (in a stationary position) at the output station, while (in the meantime) the other group of paddles moves towards or from the input station, or vice versa.

Such a stacker could be useful in any packaging apparatus for nappies, both in the case that the packaging arrangement is a bagging machine or a wrapping machine.

In this light, the present application also covers a packaging apparatus for nappies or other soft, flat, folded sanitary articles, comprising:

- stacker device for receiving nappies in a continuous succession, and arranging them into groups of nappies;
- packaging arrangement for positioning a plastic film so it is tight against a set of nappies;
- a feeder set up to feed the nappies to the packaging arrangement;
- at least one comb configured to selectively withdraw groups of nappies from the stacker device and place them on the feeder.

Said stacker device comprises a paddle structure forming a closed loop laying in a vertical plane, so that paddles are oriented horizontally at a first position in the loop defining an input station of the stacker and vertically at a second position in the loop defining an output station of the stacker.

Said paddle structure preferably comprises at least a first and a second group of paddles which are movable along the loop independently one from the other, from the inlet to the outlet and vice versa.

Preferably, the stacker comprises:

- at least a first belt, trained around a first couple of pulleys rotating around horizontal axes, and a second belt, trained around a second couple of pulleys rotating around said horizontal axes, coaxially to the first couple of pulleys;
- a first and a second drive element connected to the first and the second couple of pulleys, respectively, to move them independently one from the other;
- at least a first group of paddles, connected to the first belt to project outwardly and form housings therebetween for nappies, and a second group of paddles, connected to the second belt to project outwardly and form housings therebetween for nappies.

Likewise, the present application also covers a packaging method for nappies or other soft, flat, folded sanitary articles, comprising the following steps:

- feeding a continuous succession of nappies to a nappy stacker, at an input station of the stacker;
- moving the nappies in groups along the stacker from the input station to an output station of the stacker;
- withdrawing the groups of nappies from the output station of the stacker device through the agency of at least one comb and placing the groups of nappies on a feeder;
- feeding a set of nappies comprising one or more groups of nappies to packaging arrangement;
- positioning a plastic film so it is tight against the set of nappies in order to package the set of nappies itself.

The groups of nappies are moved in the stacker independently one from the other along a closed loop laying in a vertical plane, so that paddles are oriented horizontally at least at the input station of the stacker and vertically at least at the output station of the stacker.

Preferably, at least a first and a second group of paddles are moved around said closed loop through a first and a second drive element, respectively.

BRIEF DESCRIPTION OF DRAWINGS

These and other features of the disclosure will become more apparent from the following detailed description of a preferred, non-limiting example embodiment of it illustrated in the accompanying drawings, where.

DETAILED DESCRIPTION OF PREFERRED EMBODIMENTS OF THE INVENTION

Figures 1, 7:
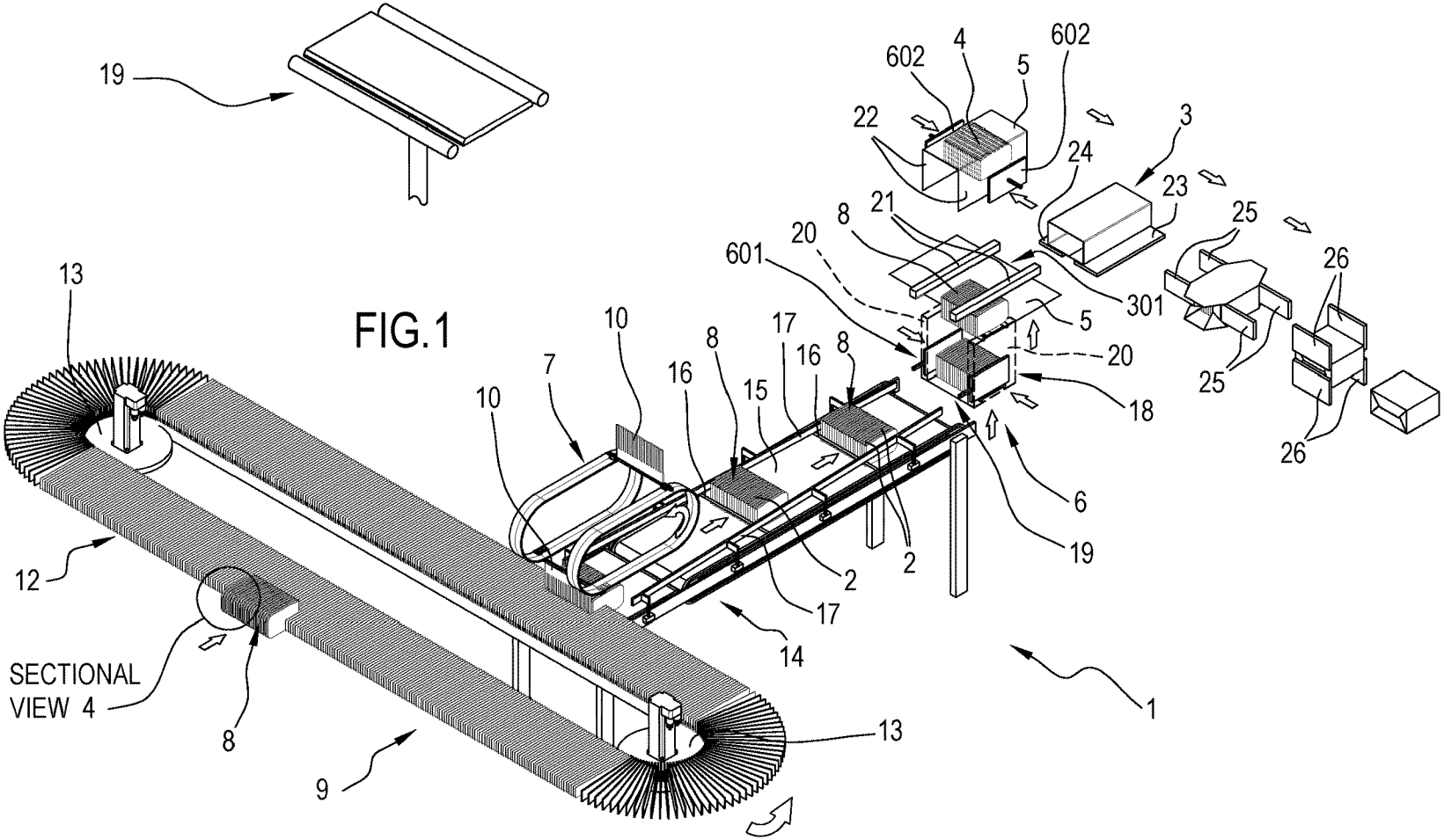
FIG. 1 schematically illustrates an apparatus according to the disclosure in a perspective view.
FIG. 7 illustrates a detail of the apparatus of FIG. 1.
Figure 2:
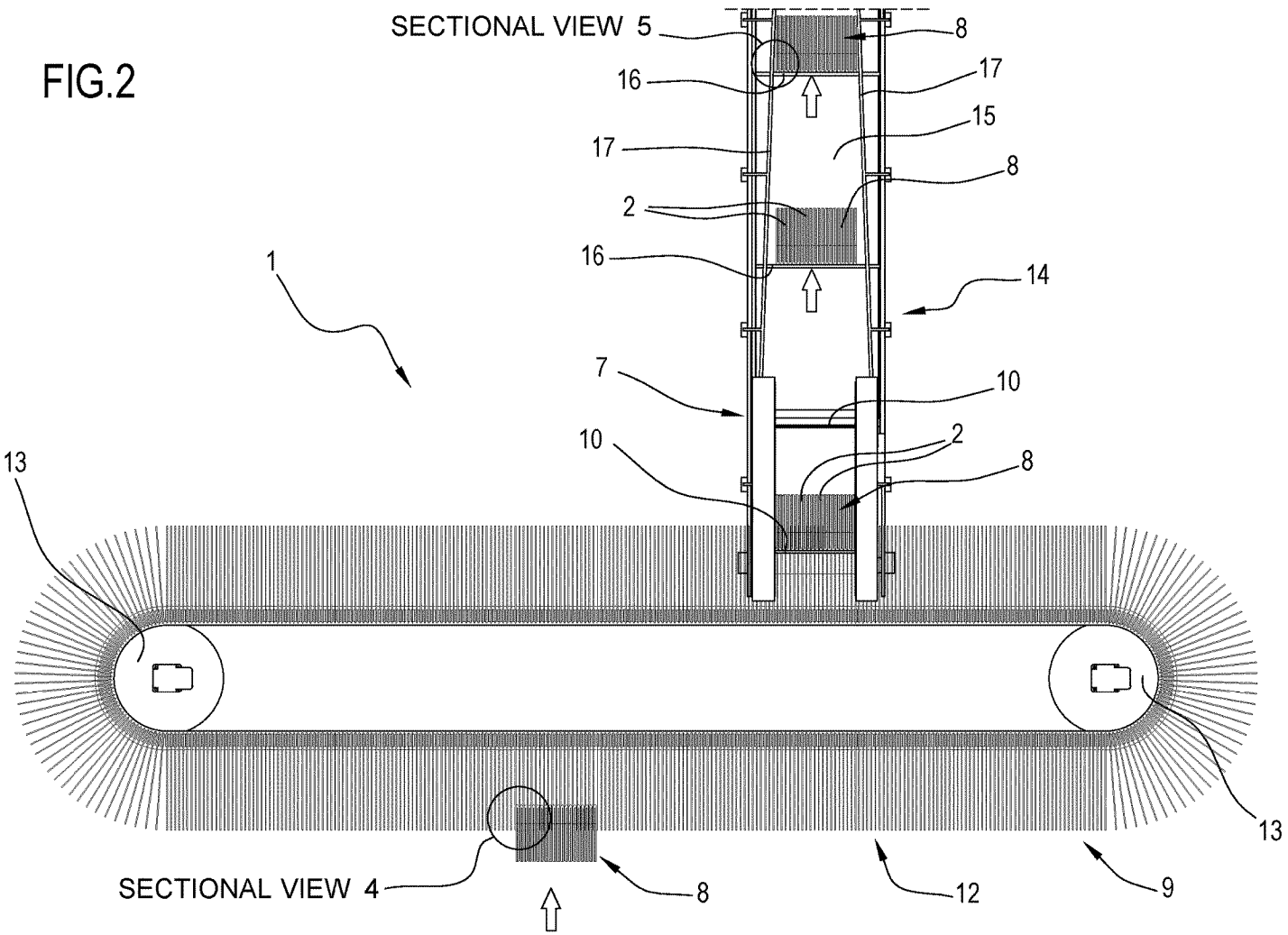
FIG. 2 illustrates a part of the apparatus of FIG. 1, in a plan view.
Figure 3:
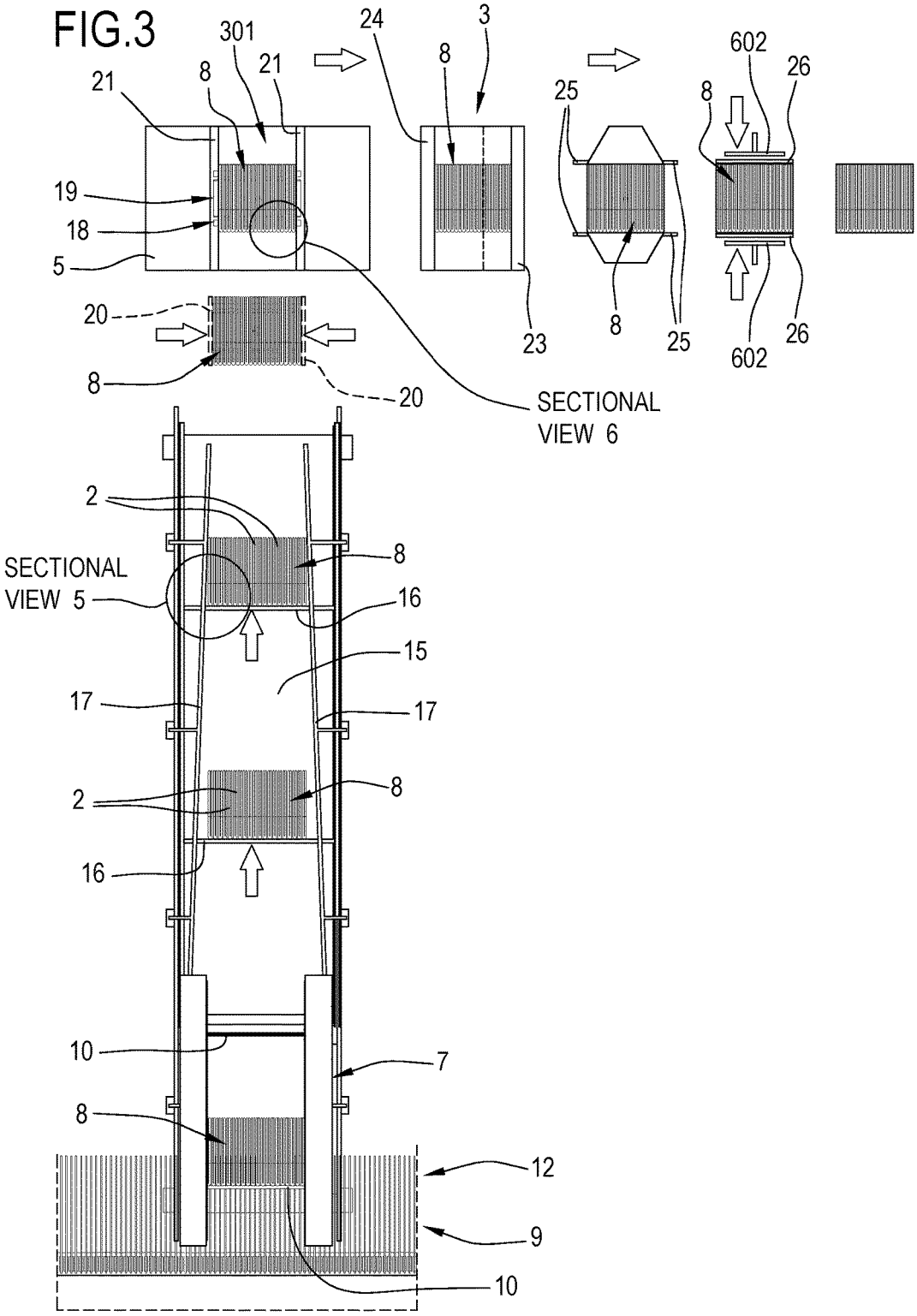
FIG. 3 illustrates another part of the apparatus of FIG. 1, in a plan view.
Figure 4:
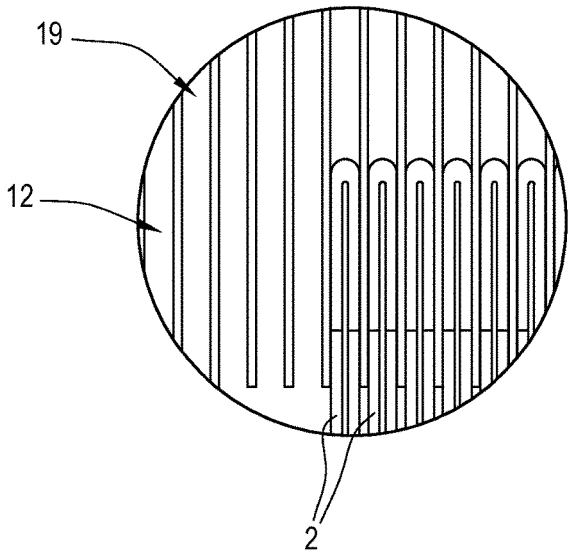
FIG. 4 shows an enlargement of the detail labelled 4 in FIG. 2.
Figure 5:
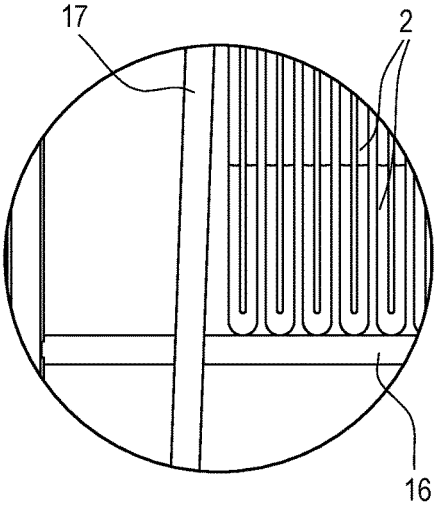
FIG. 5 shows an enlargement of the detail labelled 5 in FIG. 3.
Figure 6:
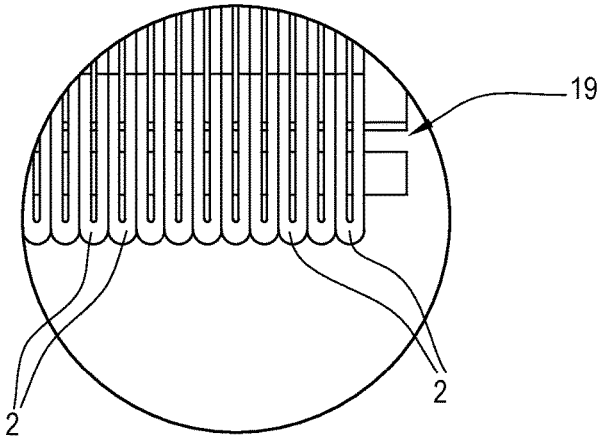
FIG. 6 shows an enlargement of the detail labelled 6 in FIG. 3.

The numeral 1 in the drawings denotes a packaging apparatus according to the disclosure.

The apparatus 1 is an apparatus for packaging nappies 2 or other soft, flat, folded sanitary articles such as, for example, sanitary towels and wet wipes. This description will hereinafter refer to "nappies" but without thereby intending to limit the scope of protection afforded by the disclosure to apparatuses which handle nappies only.

According to the disclosure, the apparatus 1 comprises a wrapping machine 3 (illustrated schematically in the drawings), configured to fold a sheet 5 of film (preferably of a plastic material) round a set 4 of nappies 2 to close it on at least three sides of the set 4 of nappies 2.

The sheet 5 is a flat blank. The sheet 5 is preferably rectangular in shape. Preferably, the sheet 5 is obtained from a roll.

The wrapping machine 3 constitutes packaging arrangement for positioning the (plastic) film so it is tight against the set 4 of nappies 2.

The apparatus 1 further comprises a feeder 6 set up to feed the nappies 2 to the wrapping machine 3.

The apparatus 1 also comprises handling means 7 configured to withdraw (preferably selectively) groups 8 of nappies 2 from a stacker device 9 for nappies 2 and to deliver them to the feeder 6.

The handling means preferably comprise a comb 10.

More specifically, the handling means 7 comprise two or more combs 10.

Preferably, the combs 10 are mounted on a movement structure 11 configured to move the combs 10 along a closed curvilinear path.

Ordinarily, the stacker device 9 (of a per se known type and not forming an integral part of the apparatus 1) comprises a paddle structure 12 trained around pulleys 13 defining a closed loop.

The paddle structure 12 defines a plurality of seats designed to receive and retain the nappies 2.

Each nappy 2 is retained between two consecutive paddles of the stacker device 9.

The nappy 2 has two opposite flat faces, a head end (defined by the fold between the two sides of the nappy 2) and a tail end, opposite the head end. The nappy 2 also has lateral edges consisting of the juxtaposed edges of the folded sides.

Thus, each nappy 2 is retained by the stacker device 9 in such a way that the two flat faces of the nappy 2 are in contact with corresponding walls of consecutive paddles of the paddle structure 12 of the stacker device 9.

More specifically, the nappies 2 are positioned with their head ends directed towards the inside of the stacker device 9 and their tail ends directed outwards.

The comb 10 has a plurality of teeth shaped in such a way that they can be inserted (as the comb 10 moves) between corresponding paddles of the stacker device 9 to strike the head end of each nappy 2, thereby pushing the nappy 2 off the stacker device 9.

The feeder 6 of the apparatus 1 comprises a conveyor 14 set up to receive the groups 8 of nappies 2 withdrawn from the stacker device 9 by the comb 10.

The stacker 9 has at an input station, where it receives nappies 2 in a continuous succession (stream), and an output station, where groups 8 of nappies 2 are the withdrawn on the feeder 6.

The groups 8 of nappies 2 are moved along the stacker 9, held between respective paddles of the paddle structure 12.

Regarding the stacker 9, the present disclosure provides two possible embodiments.

In the embodiment of FIG. 1, the closed loop defined by the stacker lays on a horizontal plane, that is, on a plane parallel to the ground.

In fact, the pulleys 13 around which the paddle structure 12 is trained have vertical rotating axes.

In this case, preferably, the paddle structure 12 extends to the whole length of said closed loop.

Hence, in this embodiment, the paddles of the stacker 9 are always vertical, independently on their position in the loop.

Preferably, the loop is movable by horizontal translation, with respect to the output station. This allows to keep the paddle structure 12 moving continuously around the loop, thus accounting for the continuous feed of nappies 2 at the input station, and, at the same time, to keep a portion of the paddle structure 12 in a stationary position adjacent to the output station, in order to allow the nappies 2 of a same group 8 to be withdrawn to the feeder 6 altogether, at once (thus achieving a discontinuous movement of nappies at output from the stacker 9).

However, this solution has two drawbacks.

Firstly, a handling unit is required upstream the input station of the stacker 9, to rotate the nappies 2 of 90 degrees (from horizontal to vertical), because the nappies are fed to the stacker 9 arranged in a horizontal plane, whilst the paddles of the stacker are vertical.

Secondly, another handling unit is required downstream the output station of the stacker 9, to rotate the nappies 2 of 180 degrees (from a position where the head end is oriented backward, to a position where the head end is oriented forward, while the nappy is parallel to a vertical plane), because the nappies are fed to the stacker 9, at the input station, arranged with their head end oriented forward, but the movement within the paddle structure 12 in the closed loop from the input station to the output station entails a 180 degrees rotation, whereby the nappies exit the output station of the stacker 9 with their head end directed backwards.

Indeed, it is preferable that the nappies 2 arrive at the packaging arrangement with their head end directed forward. This is particularly important for the packaging apparatuses which use a bagging machine as packaging arrangement; however, it would be helpful also for the packaging apparatus of the disclosure, which use a wrapping machine as packaging arrangement.

Figure 8:
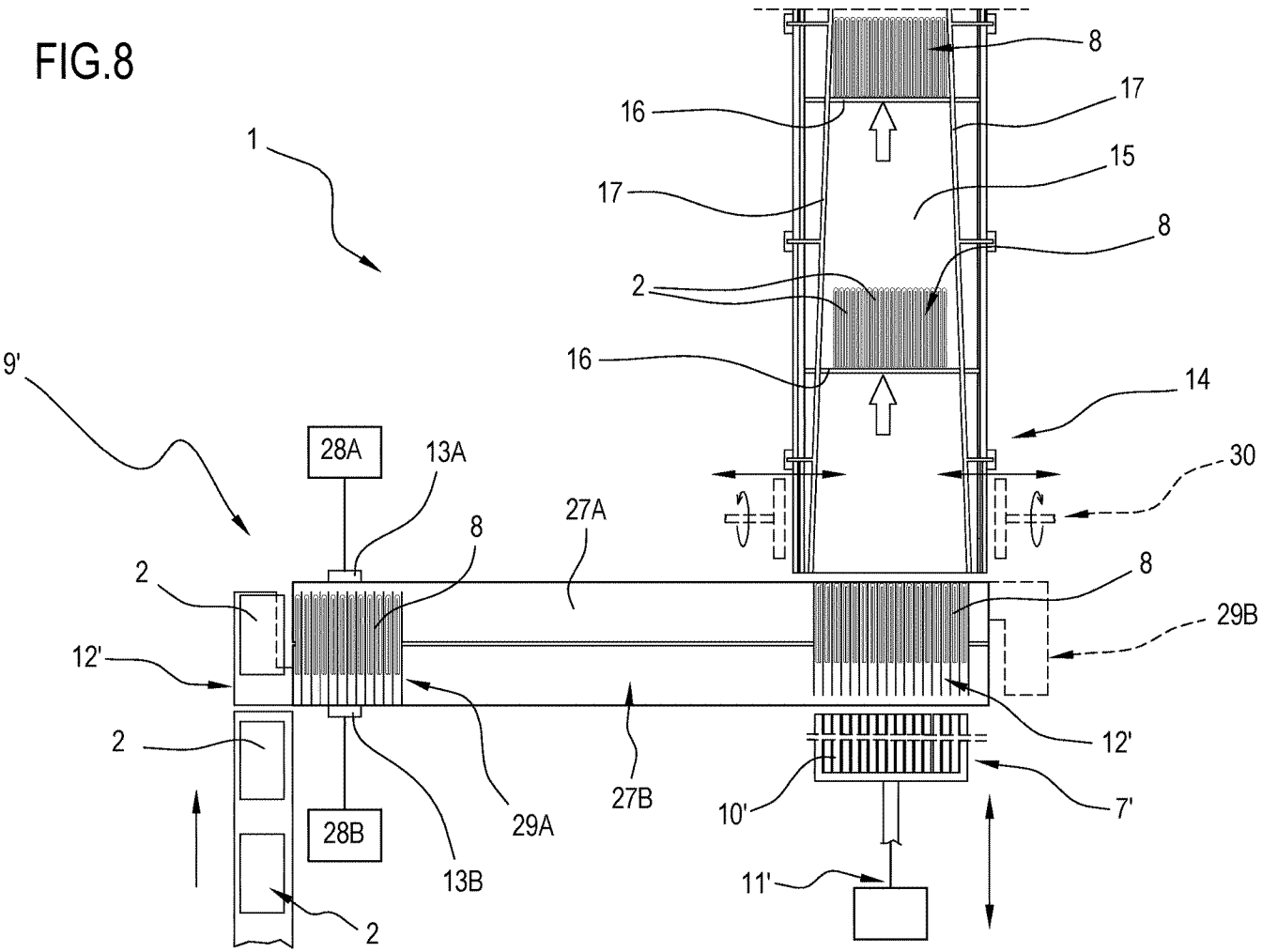
FIG. 8 illustrates a portion of the apparatus of FIG. 1, wherein the stacker is according to an alternative embodiment.

In this light, the present disclosure makes available also another embodiment for the stacker 9 (exemplified in FIG. 8).

According to this embodiment, the stacker 9' has a paddle structure 12' forming a closed loop which lays in a vertical plane, that, is, a plane perpendicular with respect to the floor.

In this way, the paddles have an inclination angle with respect to a horizontal plane (parallel to the ground) that ranges from 0 to 360 degrees, as a function of the position of the paddles in the loop.

It is noted that, in the embodiment of FIG. 8, the handling means 7, the comb 10 and the movement structure 11 have been designated with the reference characters 7', 10' and 11', respectively.

In particular, in the straight stretches of the loop the paddles are vertical: in the upper stretch the paddles project upwards, while in the lower stretch the paddles project downwards; in the curved stretches, the paddles change their inclination of 180 degrees and, in at least a position where they lay laterally with respect to the loop, they are horizontal.

In particular, the stacker defines the input station in a position where the paddles are oriented horizontally, and it defines the output station in a position where the paddles are vertical.

In addition, the paddle structure 12' comprises at least a first and a second group 29A', 29B' of paddles which are movable along the loop independently one from the other, from the inlet to the outlet and vice versa.

Preferably, the stacker 9' comprises at least a first belt 27A', trained around a first couple of pulleys 13A' rotating around horizontal axes, and a second belt 27B', trained around a second couple of pulleys 13B' rotating around said horizontal axes, coaxially to the first couple of pulleys 13A'.

Preferably, the stacker 9' further comprises a first and a second drive element 28A', 28B' connected to the first and the second couple of pulleys 13A', 13B', respectively, to move them independently one from the other.

The first group 29A' of paddles is connected to the first belt 27A' to project outwardly, and the second group 29B' of paddles is connected to the second belt 27B'.

Preferably, the apparatus 1 comprises, at the feeder 6 (on the conveyor 14, downstream the output station of the stacker 9) a manipulating unit 30, set op to grab a group 8 of nappies 2 to rotate them 180 degrees, to put them on conveyor 14 with their head ends oriented backwards; this is useful in the situations where two or more groups 8 of nappies 2 have to be packed together, wherein the two groups 8 of nappies 2 must have opposite orientations with respect to head and tail ends of the nappies.

The conveyor 14 is also set up to move the groups 8 of nappies 2 on a conveying surface and preferably translate them along a longitudinal conveying direction (this direction being preferably horizontal).

Preferably, the conveyor 14 comprises a (flat) sliding passageway 15.

The sliding passageway 15 is set up to slidably support on its top surface a group 8 of nappies 2 placed on the selfsame sliding passageway 15 on the respective lateral edges (that is, in such a way that the flat lateral faces of the nappies 2 are perpendicular to the passageway 15, that is, to the conveying surface).

The conveyor 14 preferably also comprises a plurality of crosspieces 16, transversely disposed and spaced (preferably uniformly) along the passageway 15.

The crosspieces 16 are connected to a drive system (for example a belt trained round pulleys) so as to move translationally along the passageway and to push the groups 8 of nappies 2.

Preferably, each crosspiece 16 is operatively in contact with the head ends of the nappies 2 of a corresponding group 8, so as to push them forwards along the conveyor 8, in a feed direction (away from the stacker device 9).

Preferably, the conveyor 14 of the feeder 6 comprises two side panels 17 which are configured to contain and laterally guide the groups 8 of nappies transported on the conveying plane. Preferably, the side panels 17 are inclined at an angle to each other to define a guide which is tapered in the direction of nappy 2 feed.

The feeder 6 also comprises an elevator 18.

The elevator 18 is configured to receive (or withdraw) the groups 8 of nappies 2 from the conveyor 14 and to move them along an inclined direction relative to (preferably at right angles to) the conveying surface (that is, relative to the longitudinal conveying direction).

Preferably, the elevator 18 is configured to move the groups 8 of nappies 2 upwards to the wrapping machine 3.

Preferably, the elevator 18 is configured to move the groups 8 of nappies 2 into at least a part of the wrapping machine 3.

The elevator 18 of the feeder 6 comprises a platform 19 which is movable between a lowered position where it is aligned with the conveying surface in order to receive the groups 8 of nappies 2 from the conveyor 14, and a raised position.

It should be noted that the nappies 2 are positioned on the platform 19 with their head ends directed backwards relative to the feed direction of the conveyor 14.

The elevator 18 of the feeder 6 also comprises two parallel walls 20. The platform 19 is movably interposed between the walls 20.

The walls 20 (mounted parallel to each other and preferably vertically) are configured to retain the groups 8 of nappies 2 interposed between them and to apply pressure on the flat outside faces of the nappies 2 at the ends of each group 8 of nappies 2.

The apparatus 1 preferably also comprises a presser 601 comprising, for example, two pads connected to a drive system to form the jaws of a gripper) operatively coupled to the feeder 6 and configured to press the set 4 of nappies 2 from the side (on the flat lateral faces of the group 8 of nappies 2).

It should be noted that the nappies 2 of the set 4 of nappies are juxtaposed with each other in one or more rows (one row for each group 8).

Thus, the presser is configured to compress the set 4 of nappies 2 until reaching a lateral dimension having a predetermined reference value.

Preferably, the presser (or rather, the drive system of the presser) is controlled by a (programmable) control unit.

In light of this, the presser is configured to press the set 4 of nappies 2 from the side until reaching a lateral dimension having a predetermined reference value smaller than a width defined by the infeed station of the wrapping machine 3.

The infeed station of the wrapping machine 3 is exactly set up in size to receive the set 4 of nappies 2.

The wrapping machine is configured to receive the set of nappies at the infeed station, which has a downwardly directed opening 301, that is, an opening directed toward the (elevator 18 of the) feeder 6 to receive the nappies therefrom.

Preferably, the infeed station of the wrapping machine 3 is defined by a pair of contact elements 21 exactly spaced to receive the set 4 of nappies 2.

The sheet 5 is positioned under the contact elements 21 in such a way that when the elevator 18 moves upwards vertically, it pushes the set 4 of nappies 2 between the contact elements 21, causing the sheet to be deformed and folded onto three of the six faces of the set 4 of nappies (the top face and two of the four lateral faces).

Thus, when the set 4 of nappies 2 is positioned above the infeed station of the wrapping machine 3, the sheet 5 has two flaps 22 directed downwards and defining free end edges.

The flaps 22 are further folded and joined so the sheet 5 is folded round the set of nappies 2 completely and the package completed.

In light of this, the wrapping machine 3 comprises further means for folding and means for joining (for example by sealing) the edges of the sheet.

Preferably, the wrapping machine 3 comprises a sealing device having a first folding element 23 and a second folding element 24.

Preferably, the first folding element 23 and the second folding element 24 are movable towards and away from each other to fold the flaps into contact with the underside face of the set 4 of nappies 2.

Preferably, the first folding element 23 and the second folding element 24 have respective (end) sealing surfaces configured to retain and press two edges of the sheet 5 (more specifically of the flaps of the sheet 5) interposed between them to close the sheet 5 round the bottom of the set 4 of nappies 2.

The first folding element 23 and the second folding element 24 constitute a first group of folders.

The wrapping machine 3 preferably comprises a second group 25 of folders and a third group 26 of folders, set up to fold the portions of the sheet 5 onto the two lateral faces of the set 4 of nappies 2 not yet covered by the sheet 5 itself.

This disclosure also provides a packaging method for nappies 2 (or other soft, flat, folded sanitary articles).

The method comprises the following steps:

- withdrawing groups 8 of nappies from a stacker device 9 through the agency of a comb (preferably one or more combs 10);
- placing the groups 8 of nappies 2 on the feeder 6;
- feeding a set 4 of nappies 2 (comprising one or more groups 8 of nappies 2) to the wrapping machine 3, where the sheet 5 of film (one sheet 5 for each set 4 of nappies 2 to be wrapped) has been prepared to receive it;
- folding the sheet 5 round the set 4 of nappies 2 in order to wrap it;
- closing the folded sheet 5 on at least three sides of the set 4 of nappies 2.

Preferably, the feeding step comprises the following steps:

- transporting the groups 8 of nappies (on the conveyor 14) along a conveying surface away from the stacker device 9;
- withdrawing the groups 8 of nappies 2 from the conveyor 14; and
- lifting the nappies (through the agency of the elevator 18) along a direction which is inclined at an angle to the conveying surface (preferably vertically, upwards).

It should be noted that the step of lifting the set 4 of nappies 2 (through the agency of the elevator 18) causes at least a first part of the sheet 5 to be folded.

Preferably, during the steps of transporting, withdrawing and lifting, the nappies 2 are positioned with their head ends directed rearwards relative to the feed direction while they are being transported away from the stacker device 9 (that is, with their head ends directed towards the stacker device 9).

It should also be noted that (preferably but not necessarily) the elevator 18 performs at least one movement from the lowered position (where it receives a group 8 of nappies 2 from the conveyor 14) to a storage position at a height above the lowered position but below the raised position (that is to say, at a height intermediate between the lowered position and the raised position).

This allows a group 8 of nappies 2 to be lifted and placed at the storage position (where there are retaining paddles, not illustrated, forming part of the apparatus 1 and designed to retain at least one group 8 of nappies 2 at that position, these retaining paddles being preferably power-driven, for example by a pneumatic actuator).

The elevator 18 then returns to the lowered position, receives a further group 8 of nappies 2 and moves upwards again, bringing the further group 8 of nappies 2 into contact with the group 8 of nappies 2 previously placed at the storage position.

This allows stacking of two or more groups 8 of nappies 2, to make a set 4 of nappies 2 composed of two or more groups 8 of nappies 2.

This sequence of movements is repeated by the elevator 18 until all the groups 8 of nappies 2 required to be wrapped up together have been stacked to form a single set 4 of nappies 2 to be packaged.

When the required set 4 of nappies 2 has been formed, the elevator 18 continues its upstroke to reach the wrapping machine 3.

Preferably, before the set 4 of nappies 2 is fed into the wrapping machine 3, the set 4 of nappies 2 is compressed by applying a force directed perpendicularly to the flat lateral faces of the nappies 2. This force is applied to the nappies 2 at the lateral ends of the set 4 of nappies 2.

This compressing step is performed during at least part of the feeding step.

This step of laterally compressing the set 4 of nappies 2 (which are juxtaposed with each other in one or more rows), continues until reaching a lateral dimension having a predetermined reference value which is smaller than the width of the set 4 of nappies during the folding and closing (that is, sealing) steps.

It should be noted that the lateral dimension of the set 4 of nappies 2, or of a group 8 of nappies 2, depends on the number of nappies 2 which are juxtaposed to form the set (or group) and on the compressive force applied to the set 4. That is because compression reduces the amount of air inside the nappies and squeezes them against each other.

As regards the closing step (and in particular the step of closing the sheet 5 on the underside face of the set 4 of nappies 2), this preferably comprises moving a first folding element 23 and a second folding element 24 towards each other, so as to retain and press together two edges of the sheet 5 interposed between respective surfaces of the first folding element 23 and the second folding element 24 (abuttable against each other to hold the edges of the sheet 5 in between).

The surfaces of the first folding element 23 and the second folding element 24 are preferably sealing surfaces (for example they are heated by a resistance element passing through the folding elements or by a fluid flowing inside the folding elements). Thus, the first folding element 23 and the second folding element 24 are configured to seal (as well as fold) the sheet 5 at the bottom of the set 4 of nappies 2 (in particular on the underside face of the set 4 of nappies 2).

Attention is drawn to the following as regards the implementation of this disclosure.

The apparatus 1 works in continuous cycle (and the stacker device 9 in turn operates in continuous cycle).

As regards compression of the groups 8 of nappies 2 (or the set 4 of nappies), it should be noted that two solutions are possible, as described below.

In a first solution, compression of the groups 8 of nappies 2 (or the set 4 of nappies) is performed entirely in the feeder 6 (more specifically, on the conveyor 14), without pre-compression.

In a second solution, a pre-compression step is performed first (for example on the conveyor 14) and this is followed by a final compression step (for example in the elevator 18).

Where two or more groups 8 of nappies 2 are stacked to form the set 4 of nappies 2, it is preferable to perform the pre-compression step.

Compression occurs by a lateral movement of two opposed shells which apply a force "F" which is a function of the required firmness of the nappy and of the required number of nappies in the final package (until reaching a predetermined lateral dimension).

Thus, on the conveyor 14, the groups 8 of nappies 2 are compressed or pre-compressed. On the conveyor 14, the groups 8 of nappies 2 travel at a regular distance (step) one with respect to the other.

The operation of the conveyor 14 is continuous.

The step of the conveyor 14 is preferably variable, making the operation of the conveyor 14 particularly adaptable to the operation of the stacker device 9 which transfers products to it.

As the groups 8 of nappies 2 are advanced along the feeder 6, the lateral dimensions of the groups 8 of nappies 2 increase.

This phenomenon (which is undesirable) is corrected by the control unit which drives the presser in such a way as to compress the groups 8 of nappies 2 until reaching a dimension smaller than that actually required for the set 4 of nappies 2 when packaged and completed.

During folding of the sheet 5 round the set 4 of nappies 2, the set 4 of nappies 2 is laterally retained (along the direction of compression applied to the set 4 of nappies 2) by a carriage (not illustrated in the drawings) comprising two walls.

Preferably, the wrapping machine 3 comprises a further presser 602, i.e. further presser means, to further compress the set 4 of nappies 2 before the edges of the sheet 5 are sealed round the underside face of the set 4 of nappies 2.

This allows dimensional errors to be corrected and ensures that the finished package is of the required size.

The further presser means comprise, for example, a drive system for moving the walls of the carriage relative to each other.

Preferably, the wrapping machine 3 comprises a first and a second carriage movable relative to each other to compress the set 4 of nappies 2 held by them.

The two carriages are moved by actuators connected to a control unit. The control unit is programmed to apply compression (when necessary) to the group of nappies which has just been wrapped on three sides, before the fourth side is closed.

Furthermore, compression is applied when the groups 8 of nappies 2 are on the elevator 18. Thus, the presser is positioned along the movement path of the elevator 18, at a predetermined height from the conveyor 14 (or the presser might be coupled to the elevator 18).

This configuration has the advantage of making the apparatus particularly simple to construct and of reduced size.

It should be noted that the presser is positioned along the movement path of the elevator 18, preferably at the height of the conveyor 14 (that is, of product feed) when the elevator 18 is at the lowered position.

Preferably, the elevator 18 is stationary during compression and only subsequently moves upwards.

In a variant embodiment, the presser is movable synchronously with the elevator 18 so as to apply compression while the elevator 18 is moving (thereby saving time).

With regard to the step of folding and closing the sheet 5, attention is also drawn to the following.

As soon as the set 4 of nappies 2 has reached a wrapping station in the wrapping machine 3 and is held securely between the blades (or walls) of the carriage (constituting an outfeed carriage designed to move the packaged set 4 out of the machine 3), the bottom folders 23, 24 create a tube (by suitably shaping the sheet 5) round the set 4 of nappies 2.

It should be noted that the set 4 of nappies 2 is moved at output of the wrapping machine 3 in a perpendicular direction to feeding longitudinal direction of group 8 in conveyor 14.

After the bottom folders 23, 24, the groups of lateral folders 25 (and/) or the lateral folders 26 come into operation.

Sealing preferably comprises a bottom seal and lateral seals of the folds of the sheet 5 made by the lateral sealers.

Lateral sealing can be performed in two ways:

- one with sealers associated with the folders 26; this seal is applied immediately after making three folds on the tube shaped sheet, while the tube flaps are held up by Venturi effect or suction systems (after which the sealers, whether fixed or movable, come into operation);
- one with sealers coupled to the folders 25 (which operate preferably simultaneously with the folders 23 and 24, that is, during the same step in the cycle).

The bottom seal can be performed in two ways (irrespective of the method adopted for the lateral seal):

- using a sealer forming part of the folders 23 and 24 as described above;
- using a sealing system external of the folders 23 and 24 and having a flat contact element configured to intercept the flaps of the sheet 5 folded (by the folders 23 and 24) and overlapping each other, so as to seal them by pressure and heating.

This allows the set 4 of nappies 2 to be packaged in bundle style.

With regard to the sealing step, attention is also drawn to the following.

When the set 4 of nappies 2 has been lifted by the elevator 18 and after the sheet 5 has been folded first by the contact elements 21 and then by the bottom folders 23 and 24, the sheet 5 is partly wrapped round the set 4 of nappies and has adopted the shape of a tube.

In light of this, it should be noted that the apparatus 1 comprises a Venturi effect air jet system (not illustrated) set up to keep the upper and lower flaps of the tube formed by the sheet 5 in the outstretched condition during (at least one final step of) sealing.

During sealing of the lateral portions of the sheet (the ends of the tube formed by the sheet) the air jet system remains on.

Sealing comprises. For example, a sealing system which is adjustable according to the depth of the products and with a double sealer, upper and lower, (not illustrated).

The system is double because it is mounted on both the right-hand and left-hand flank of the machine 3.

Preferably, the upper sealer (of the sealers which apply the lateral seal) has a rubber profile for containing the film during closure. Preferably this sealer has a wire through which electricity is made to flow in order to seal the surfaces. Preferably, the sealer has a pneumatically controlled cutter blade. Preferably, the sealer has a further rubber. Preferably, the sealer has a suction plate.

The lower sealer is symmetrical to the upper sealer (in terms of position and shape) but preferably has a cavity instead of the cutter blade and a pre-heated rubber section instead of the sealing wire.

Preferably, the sealers are moved by a single drive system which can be adjusted to guarantee that the seal can be centred as a function of the height of the package.

The suction system has a twofold function: that of keeping the flaps of the sheet 5 in an outstretched condition during operation of the sealers and that of trimming (offcuts of the sheet 5) after a step of cutting the excess parts of the sheet (separated from the sheet constituting the package by the sealed seam line).

More specifically, the sealing cycle (sealing the lateral portion of the tube-shaped sheet 5) is divided into four steps.

In a first sealing step, the sealer is open and the upper and lower flaps are held in place by suction.

In a second sealing step, the sealer is 75% closed, with the suction system on, and with a mechanical (or pneumatic) pocket forming mechanism which impacts the film 5 and causes it to be folded.

In a third sealing step, the sealer is closed, the sealer surfaces come into operation and, after a present time (sealing time), the cutter blade is activated.

In a fourth sealing step, the sealer is open, at a position where it is clear of the set 4 of nappies 2, and the pocket forming system is fully open.

It should also be noted that (with the double carriage solution) the apparatus might comprise sealers which can move along with the carriages. That way, movement away from the elevator raised point would be advanced, to the advantage of cycle speed, because sealing occurs while in motion and not stationary.

The advantage is due to the fact that without this movement, the sealer operates only when the product is stationary. The stationary time must coincide with the arrival of the product just lifted and must be equal in length to the sealing time. On the other hand, packaging speed is faster if sealing occurs while in motion (during transfer from the elevator 18 to the first station of the machine 3).

The sealing process described above can be adopted (in whole or in part) also for the secondary packaging step, where necessary.

The invention claimed is:

1. A packaging apparatus for nappies or other soft, flat, folded sanitary articles, comprising:

a feeder for receiving a set of nappies, wherein the set of nappies comprises one or more groups of nappies, the feeder comprising a conveyor for receiving the groups of nappies from a nappy stacker device and moving them onto a conveying plane, and an elevator configured to receive the set of nappies from the conveyor and to move them into an infeed station of a wrapping machine;

a packaging arrangement, for positioning a plastic film against the set of nappies, the packaging arrangement including the wrapping machine configured to fold a sheet of the film around the set of nappies to cover at least three sides of the set of nappies and to seal the sheet of film around the set of nappies, the wrapping machine including the infeed station having an opening directed towards the feeder;

at least one comb configured to selectively withdraw groups of nappies from the nappy stacker device and place them on the feeder;

a presser operatively coupled to the feeder and configured to laterally compress the set of nappies on a plurality of lateral sides;

a programmable controller, which controls the presser to compress the set of nappies until reaching a lateral dimension having a predetermined reference value smaller than a width of the opening of the infeed station of the wrapping machine;

a further presser, controlled by the controller to apply a further lateral compression to the set of nappies which has been covered on the at least three sides, before the sheet of film is sealed around the set of nappies, the further presser being arranged such that the further lateral compression is applied to said plurality of lateral sides of the set of nappies, wherein said at least three sides which have been covered by the sheet of film comprise said plurality of lateral sides of the set of nappies.

2. The apparatus according to claim 1, wherein the elevator is configured to move the set of nappies along an inclined direction at an angle to the conveying plane, and into the wrapping machine.

3. The apparatus according to claim 2, wherein the conveyor of the feeder comprises two side panels which are configured to contain and laterally guide the groups of nappies transported on the conveying plane and which are inclined at an angle to each other to define a guide tapered in the direction of nappy feed.

4. The apparatus according to claim 2, wherein the elevator of the feeder comprises:

a platform which is movable between a lowered position where it is aligned with the conveying plane in order to receive the groups of nappies from the conveyor, and a raised position, the nappies having a head end defined by the fold between the sides of each nappy and directed backwards relative to the direction of feed of the nappies themselves on the conveyor;

two parallel walls, the platform being movably interposed between the walls.

5. The apparatus according to claim 1, wherein the wrapping machine comprises a sealing device having a first and a second folding element movable towards and away from each other and having respective sealing surfaces configured to retain and press together two edges of the sheet interposed between them in order to close the sheet around the set of nappies.

6. The apparatus according to claim 1, wherein the nappy stacker device has a paddle structure forming a closed loop laying in a vertical plane, whereby paddles are oriented horizontally at a first position in the loop defining an input station of the stacker and vertically at a second position in the loop defining an output station of the stacker, wherein said paddle structure comprises at least a first and a second group of paddles which are movable along the loop independently one from the other, from the inlet to the outlet and vice versa.

7. The apparatus according to claim 6, wherein the stacker comprises:

at least a first belt, trained around a first couple of pulleys rotating around horizontal axes, and a second belt, trained around a second couple of pulleys rotating around said horizontal axes, coaxially to the first couple of pulleys;

a first and a second drive element connected to the first and the second couple of pulleys, respectively, to move the pulleys independently one from the other, wherein the at least a first group of paddles is connected to the first belt to project outwardly and form housings therebetween for nappies, and the second group of paddles is connected to the second belt to project outwardly and form housings therebetween for nappies.

8. A packaging method for nappies or other soft, flat, folded sanitary articles, comprising the following steps:

withdrawing groups of nappies from a nappy stacker device through at least one comb and placing the groups of nappies on a feeder;

feeding a set of nappies comprising one or more groups of nappies to a packaging arrangement, through the feeder, wherein the feeder comprises a conveying surface for receiving the groups of nappies from the nappy stacker device and an elevator configured to receive the set of nappies from the conveying surface and to move them into an infeed station of a wrapping machine of the packaging arrangement;

positioning a plastic film against the set of nappies in order to package the set of nappies;

preparing a sheet of the film;

folding the sheet around the set of nappies in order to wrap the sheet around three sides of the set of nappies, by using the elevator to elevate the nappies through the infeed station having an opening directed towards the feeder for receiving the set of nappies;

sealing the folded sheet around the set of nappies, laterally compressing the groups of nappies until reaching a lateral dimension having a predetermined reference value which is smaller than a width of the opening of the infeed station, wherein said compression is performed by a presser during at least a part of the feeding step, on a plurality of lateral sides of the set of nappies, and wherein the step of laterally compressing further includes a further lateral compression applied to the set of nappies which has been wrapped on said three sides, before the sheet is sealed around the set of nappies, through a further presser, and wherein said further lateral compression is applied to said plurality of lateral sides of the set of nappies, wherein said three sides which have been wrapped by the sheet of film comprise said plurality of lateral sides of the set of nappies.

9. The method according to claim 8, wherein the feeding step comprises the following steps:

transporting the groups of nappies along the conveying surface away from the stacker device;

withdrawing the groups of nappies from the conveying surface; and lifting the set of nappies, with the elevator, along a direction which is inclined at an angle to the conveying surface, wherein the folding step is performed at the same time as at least a final part of the lifting step.

10. The method according to claim 9, wherein, during the steps of transporting, withdrawing and lifting, the nappies are positioned with their head ends, defined by the fold between the sides of each nappy, directed rearwards relative to the feed direction while being transported away from the stacker device.

11. The method according to claim 8, wherein the groups of nappies are juxtaposed with each other in one or more rows, wherein the predetermined reference value of said lateral dimension is smaller than the width of the set of nappies during the folding and sealing steps, and wherein the lateral compression of the groups of nappies is performed during at least a part of the feeding step.

12. The method according to claim 8, wherein sealing comprises a step of moving a first and a second folding element towards each other in order to retain and press two flaps of the sheet interposed between respective sealing surfaces of the folding elements, to seal the sheet around the set of nappies.

13. The method according to claim 8, comprising the following steps: preparing a further sheet of film; folding the further sheet around two or more previously packaged sets of nappies; sealing the folded further sheet on at least three sides of a volume defined by the plurality of packaged sets of nappies.

14. The method according to claim 8, comprising the following steps:

feeding a continuous succession of nappies to the stacker, at an input station of the stacker;

moving the nappies in groups along the stacker from the input station to an output station of the stacker, where the groups of nappies are withdrawn onto the feeder, wherein the groups of nappies are moved in the stacker independently one from the other along a closed loop laying in a vertical plane, so that paddles are oriented horizontally at least at the input station of the stacker and vertically at least at the output station of the stacker.

15. The method according to claim 14, wherein at least a first and a second group of paddles are moved around said closed loop through a first and a second drive element, respectively.

16. The method of claim 8, comprising the following steps:

feeding a continuous succession of nappies to a nappy stacker, at an input station of the stacker;

moving the nappies in groups along the stacker from the input station to an output station of the stacker, wherein the groups of nappies are moved in the stacker independently one from the other along a closed loop laying in a vertical plane, so that paddles are oriented horizontally at least at the input station of the stacker and vertically at least at the output station of the stacker.

17. The method according to claim 16, wherein at least a first and a second group of paddles are moved around said closed loop through a first and a second drive element, respectively.

* * * * *